US005461890A

United States Patent [19]

LeFavor

[11] Patent Number: 5,461,890

[45] Date of Patent: Oct. 31, 1995

[54] HANDCUFF LEVERAGE DEVICE

[76] Inventor: Richard LeFavor, 7692 Kingsview La., Maple Grove, Minn. 55311

[21] Appl. No.: 195,525

[22] Filed: Feb. 14, 1994

[51] Int. Cl.[6] ..... E05B 75/00

[52] U.S. Cl. ..... 70/16

[58] Field of Search ..... 70/14–17

[56] References Cited

U.S. PATENT DOCUMENTS

| | | | |
|---|---|---|---|
| 1,746,890 | 2/1930 | Gill . | |
| 1,803,280 | 4/1931 | Stull et al. | 70/16 |
| 2,383,077 | 8/1945 | Powell | 70/17 |
| 2,966,787 | 1/1961 | Tompkins | 70/16 |
| 3,616,665 | 11/1971 | Rosenthal | 70/16 |
| 3,618,345 | 11/1971 | Smith | 70/16 |
| 4,138,867 | 2/1979 | Tompkins | 70/16 |
| 4,300,368 | 11/1981 | Sullivan | 70/16 |
| 4,840,048 | 6/1989 | Elam | 70/16 |
| 5,205,142 | 4/1993 | Kruger | 70/16 |
| 5,233,848 | 8/1993 | Elam | 70/16 |

FOREIGN PATENT DOCUMENTS

| | | | |
|---|---|---|---|
| 763926 | 2/1934 | France . | |
| 363156 | 11/1922 | Germany . | |
| 408270 | 12/1944 | Italy . | |
| 113002 | 1/1945 | Sweden | 70/17 |

*Primary Examiner*—Peter M. Cuomo
*Assistant Examiner*—Suzanne L. Dino
*Attorney, Agent, or Firm*—Amy J. Hoffman; Robert A. Elwell

[57] ABSTRACT

The handcuff assembly comprises a first wrist encircling means for selectively encircling one wrist, a second wrist encircling means for selectively encircling a second wrist, and a connecting means for rigidly connecting the first wrist encircling means to the second wrist encircling means. The connecting means comprises an elongated body having an opening therein suitable for acting as a receptacle for a hand to allow the connecting means with opening to serve as a device to acquire leverage over the detainee whose wrists are secured in the shackles.

3 Claims, 2 Drawing Sheets

HANDCUFF LEVERAGE DEVICE

FIELD OF THE INVENTION

The present invention relates to handcuff assemblies for locking a suspect's wrists together. Specifically, the present invention relates to handcuff assemblies which an officer may place on a suspect's or detainee's wrists without requiring both of the officer's hands for placement. More specifically, the present invention also provides a handle which can serve to acquire leverage over a detainee and quiet the detainee if he or she is unruly.

Background of the Invention

Handcuffs commonly known in the art include two shackles and a chain which serves as a connecting means between the two shackles. Those familiar with handcuffs know that one shackle is placed about one of the suspect's wrists while the second shackle is placed about the second of the suspect's wrists. Such a handcuff assembly adequately restrains a suspect once it is placed upon a suspect's wrists.

Law enforcement officers and the general public are in danger until a handcuff assembly is securely placed upon a suspect's wrists. Officers place themselves in additional danger when they attempt to place a handcuff assembly on a suspect's wrists. An officer must use two hands to place a chain-linked handcuff assembly on a suspect. In order to free both hands for handcuff placement, the officer must relinquish his or her weapon by placing it in a holding device such as a holster. The weapon remains in the officer's holster until the handcuff assembly is secured on the suspect's wrists. This leaves the officer exceedingly vulnerable to attack by the suspect during securement of the handcuffs. Not only is the officer's gun in its holster, but both of the officer's hands are occupied leaving neither hand free to reach for a gun in case of sudden movement by the suspect.

In addition to difficulties with securing chain-linked handcuff assemblies on suspects, other problems are inherent with chain-linked assemblies. U.S. Pat. No. 4,300,368 discusses disadvantages with chain-linked handcuff assemblies. The problems include failure to adequately restrict a detainee's movement because the detainee can twist his or her hands and bring his or her wrists and hands together. Further, the chain is susceptible to breaking through manipulation of the detainee's hands. The '368 patent discloses a handcuff assembly which supposedly overcomes the problems inherent with chain-linked handcuff assemblies. The '368 assembly provides two shackles connected by a single link. This assembly may restrict a detainee's movement and may also overcome the risk of a detainee breaking the chain linkage between the shackles. However, the '368 assembly still requires an officer to use two hands in order to place the shackles on a suspect because the shackles are free to move with respect to each other.

U.S. Pat. Nos. 2,966,787, 3,618,345, 5,205,142, disclose handcuff assemblies which provide two shackles hinged together. The handcuffs of the listed patents are provided with different hinge mechanisms. None of the patents overcome the problems addressed by the present invention.

SUMMARY OF THE INVENTION

Figure 1:
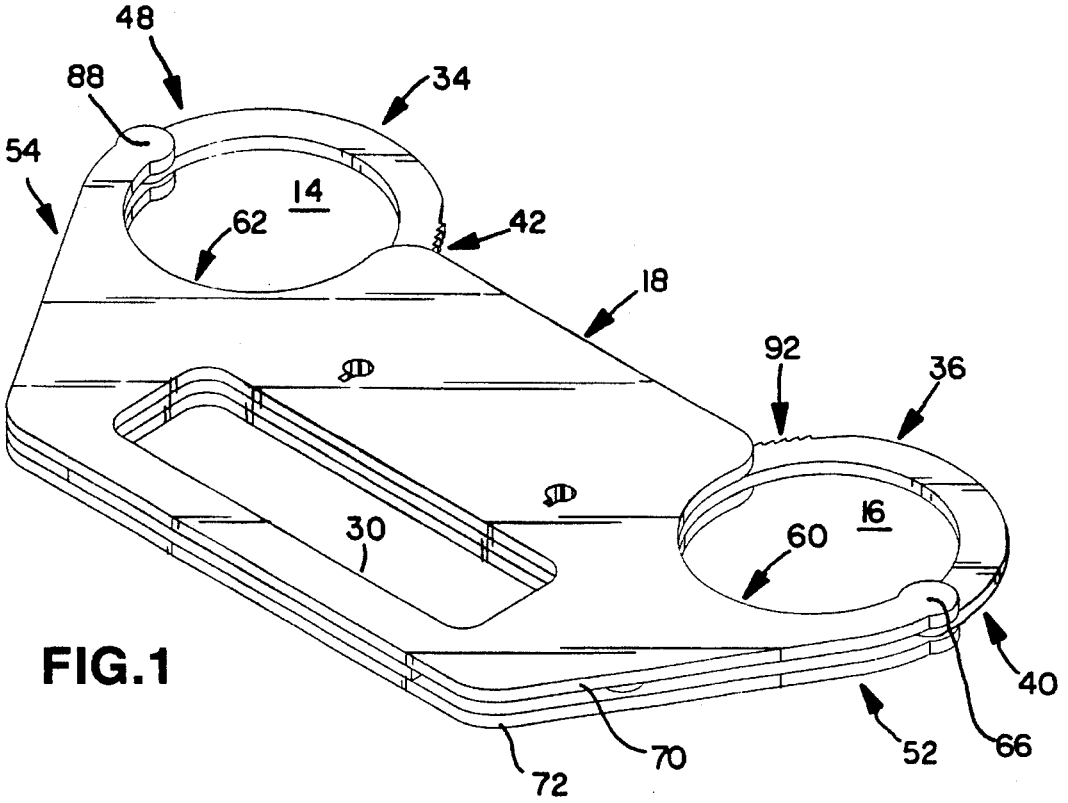
FIG. 1 is a perspective view of one embodiment of the handcuff of the present invention.
Figure 2:
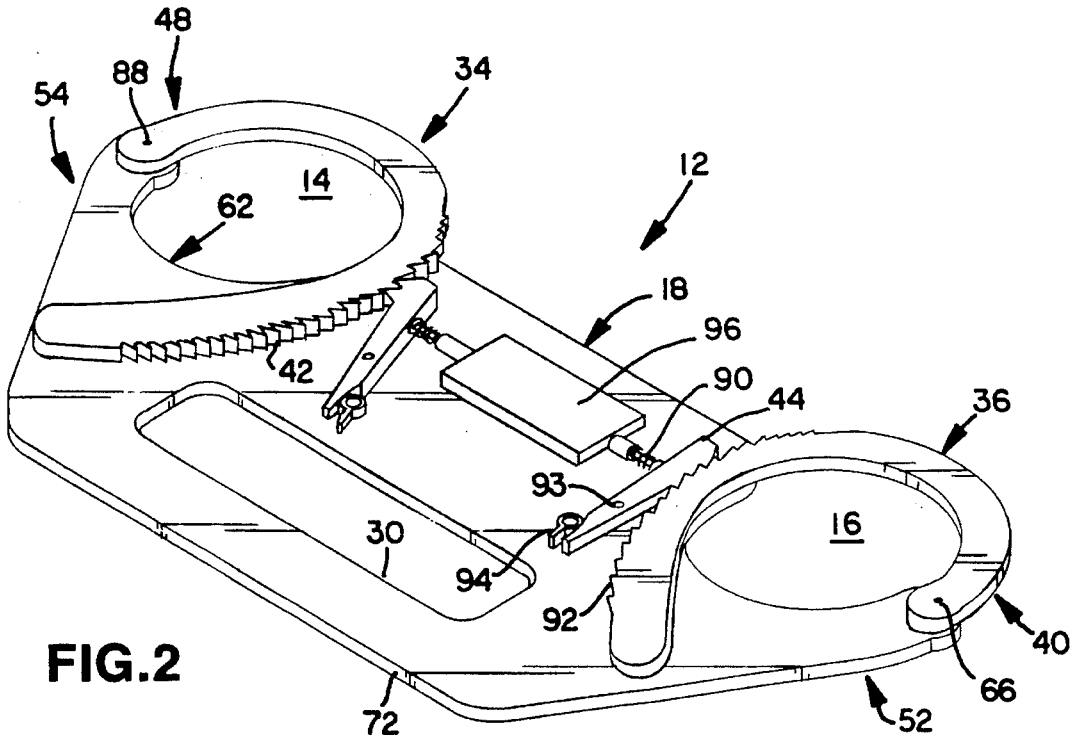
FIG. 2 is a perspective and partially exploded view of the handcuff shown in FIG. 1.

The present invention provides a design of a handcuff assembly which allows a law enforcement officer to place the shackles on a suspect's wrists while only using one hand. This decreases the officer's vulnerability while shackling a suspect with handcuffs. With the present invention the officer may secure both of a suspect's wrists while still maintaining a weapon in a ready position. Beyond allowing placement with one hand, the present invention further includes a feature which allows the assembly to serve as a device to acquire leverage over the detainee.

Two embodiments of the handcuff assembly are disclosed. One of the embodiments includes a rigid connecting member between the two shackles. The rigid connecting member provides the least opportunity for a detainee to break or disconnect the connecting member and thereby release him or herself from the handcuffs. The second embodiment includes a hinged connecting member which allows an officer to fold the two shackles on top of each other to reduce the size of the handcuffs for storing purposes. Both of the embodiments include an aperture in the connecting member which provides a law enforcement officer a place to put his or her hand. The handcuff assembly with an opening therein provides a device by which the officer may acquire additional leverage over the detainee in the event that the detainee is unruly.

The handcuff assembly comprises a first wrist encircling means for selectively encircling one wrist, a second wrist encircling means for selectively encircling a second wrist, and a connecting means for rigidly connecting the first wrist encircling means to the second wrist encircling means. The connecting means comprises an elongated body having an opening therein suitable for acting as a receptacle for a hand to allow the connecting means with opening to serve as a device to acquire leverage over the detainee whose wrists are secured in the shackles.

Another embodiment of the handcuff assembly comprises a first wrist encircling means for selectively encircling one wrist, a second wrist encircling means for selectively encircling a second wrist, and connecting means for connecting the first wrist encircling means to the second wrist encircling means. The connecting means includes a first elongated body having a first end for attaching to the first wrist encircling means and having a second end and a second elongated body having a first end for attaching to the second wrist encircling means and having a second end. The second ends of the elongated bodies are provided with cooperating hinge rings, a pin is disposed between the cooperating hinge rings to pivotally couple the second ends of the first and second elongated bodies together. Alternatively, a hinge lock assembly is disposed between the cooperating hinge rings to selectively allow pivoting of the elongated body means. The lock means having a locked and an unlocked position. The connecting means has an opening therein suitable for acting as a receptacle for a hand to allow the handcuff assembly to serve as a device to acquire leverage over the detainee whose wrists are secured in the shackles.

DETAILED DESCRIPTION OF THE INVENTION

The handcuff assembly 12 of the present invention includes two wrist encircling means or shackles generally shown as 14 and The shackles 14 and 16 are each comprised of a U-shaped member 34 and 36 which is pivotally connected to a connecting means 18 at one end 40 and 48 and ratcheted 42 and 92 at the other end. The connecting means 18 includes two ends 52 and 54. Each end 52 and 54 of the connecting means 18 is provided with hemispherical shaped openings 62 and 60 which further comprise the shackles 14 and The shackles 14 and 16 are identical. For brevity, only one shackle is referred to hereafter.

The U-shaped member 36 freely pivots about the pivot point 66 in a full circle, however, the U-shaped member 36 may only rotate in one direction. The ratchets 92 on the U-shaped member 36 are met by a spring-loaded 90 pawl 44. The ratchets 92 allow the U-shaped member 36 to rotate in only one direction. If a detainee's wrist is placed in the shackle, the U-shaped member 36 is prohibited from rotating in a complete circle. The pawl 44 prohibits the U-shape member from retracting. Thus, the shackle is "locked" and is only unlocked with a key. The key actuates a rotable cam 94 which when rotated causes the pawl 44 to pivot on pin 93 and away from ratchets 92 releasing U-shape member 36 and allowing it to retract. A standard key lock 94 as is commonly known in the art is employed in the present invention.

Each of the shackles 14 and 16 is suited for placement about a suspect's wrist. The handcuff assembly is used by placing a first shackle 14 about one of the suspect's wrists and placing a second shackle 16 about the suspect's remaining wrist. Placement of the individual shackles is easily accomplished with the present invention. An officer merely strikes a suspect's wrist with one of the shackles 14 or 16 causing the U-shaped member 34 or 36 to pivot about pivot pin 88 or 66 until the ratchets contact the pawl.

In the first embodiment the connecting means 18 is comprised of a single elongated member. The elongated member is comprised of two plates 70 and 72 which sandwich the U-shaped members 34 and A pin 88 or rivet pierces the first plate 70 of the elongated member. The pin 88 then pierces the U-shaped member 34 and finally pierces the second plate 72 of the elongated member thus securing the three pieces together. Because the elongated member 18 is comprised of two plates 70 and 72 which are set apart by the distance created by the width of the U-shaped members 34 and the elongated member 18 is substantially hollow. If the U-shaped member 36 is rotated in the direction allowed by the ratchet 92 and pawl 44, the U-shaped member 36 freely rotates about the pin 88 in a complete circle.

The present invention is preferably manufactured to allow the U-shaped member 34 to swing easily. Even if the U-shaped member 34 is closed, an officer may still easily place the shackle 14 upon a suspect's wrists. The officer simply strikes the suspect's wrist with the U-shaped member 34 displacing the U-shaped member 34 causing it to rotate. The ratchets 42 on the U-shaped member 34 move entirely through the pawl 44. The U-shaped member 34 continues to rotate in a complete circle with the momentum it received when the U-shaped member 34 struck the suspect's wrists. The U-shaped member 34 continues rotating until the ratchets 42 again contact the pawl. The suspect's wrist impedes further rotation of the U-shaped member 34 and the shackle 14 is secured about the suspect's wrist.

The two plates 70 and 72 of the elongated connecting member 18 are fastened together by pins 66 and 88 and additionally by rivets, welding, or other means commonly known in the industry in the center of the member 18. A spacing plate 96 may be placed between plates 70 and 72. Plates 70 and 72 may each be fastened to opposite sides of plate 96 to provide additional fastening which provides stability for the member 18 and reduces the likelihood that the two plates 70 and 72 will disconnect. The additional fastening is preferably concentrated in the center of the elongated connecting member 18 to avoid interruption of the free rotation of the U-shaped members 34 and 36.

In a second embodiment, the connecting member 118 is comprised of two elongated members 120 and 124 which are hinged. The hinged elongated members 120 and 124 are similar to the single elongated member 18 described above except that the hinged elongated members 120 and 124 are comprised of a single elongated member which was divided into two pieces by cutting perpendicularly across its width. The two hinged elongated members 120 and 124 are identical and again, for brevity only one of the two elongated members is described.

The hinged elongated member 124 includes a first end 154 and a second end 180. Sandwiched between the second end of the hinged elongated member 124 are tabs 90 which are connected to hinge rings 192. The hinge rings 192 protrude from the two plates 170 and 270 and 272 which comprise the hinged elongated members 120 and 124. A set of hinge rings 192 protrudes from the tabs 90 fixed between the plates 270 and 272 of first hinged elongated member 124 while a cooperating set of hinge rings 193 protrudes from the tabs 90 fixed between the plates 170 and 172 of the second hinged elongated member 120. When aligned, the hinge rings accept a pin 150. The elongated members 120 and 124 pivot about pin 150 allowing an officer to fold the shackles 114 and 116 together.

Figure 3:
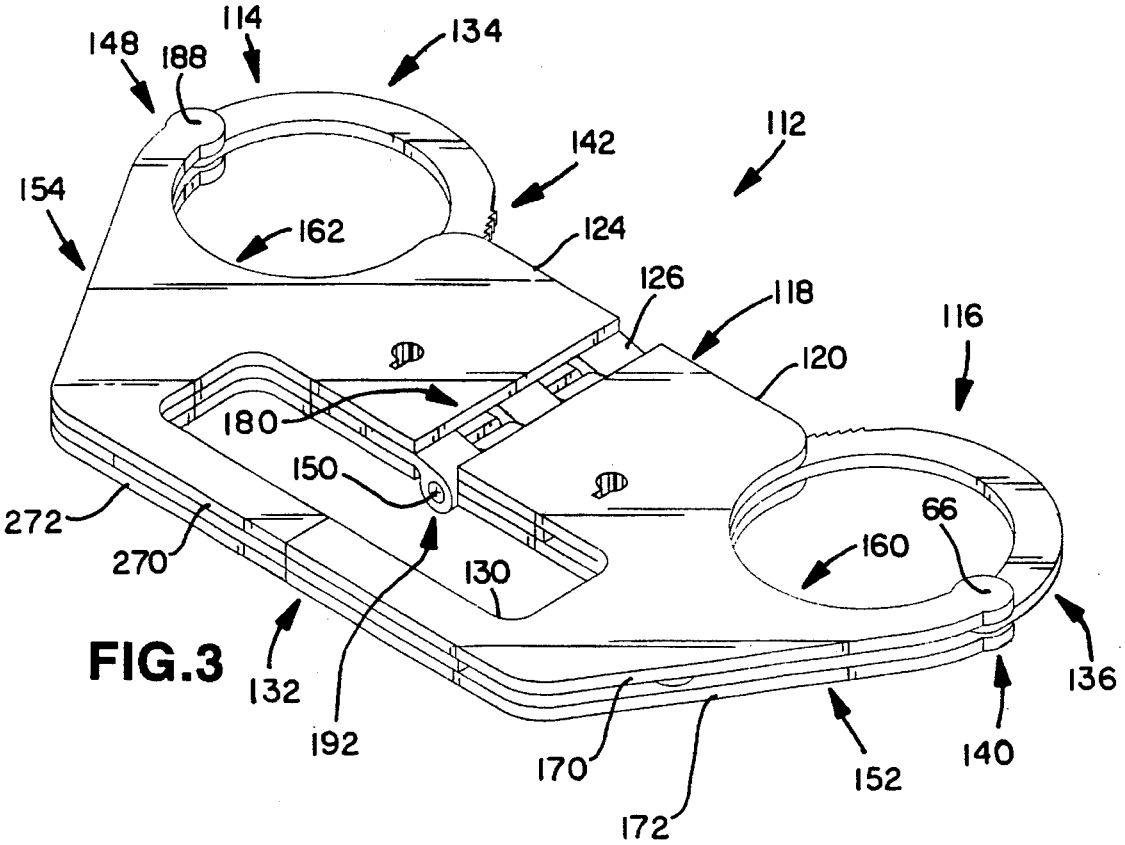
FIG. 3 is a perspective view of one embodiment of the present invention.
Figure 4:
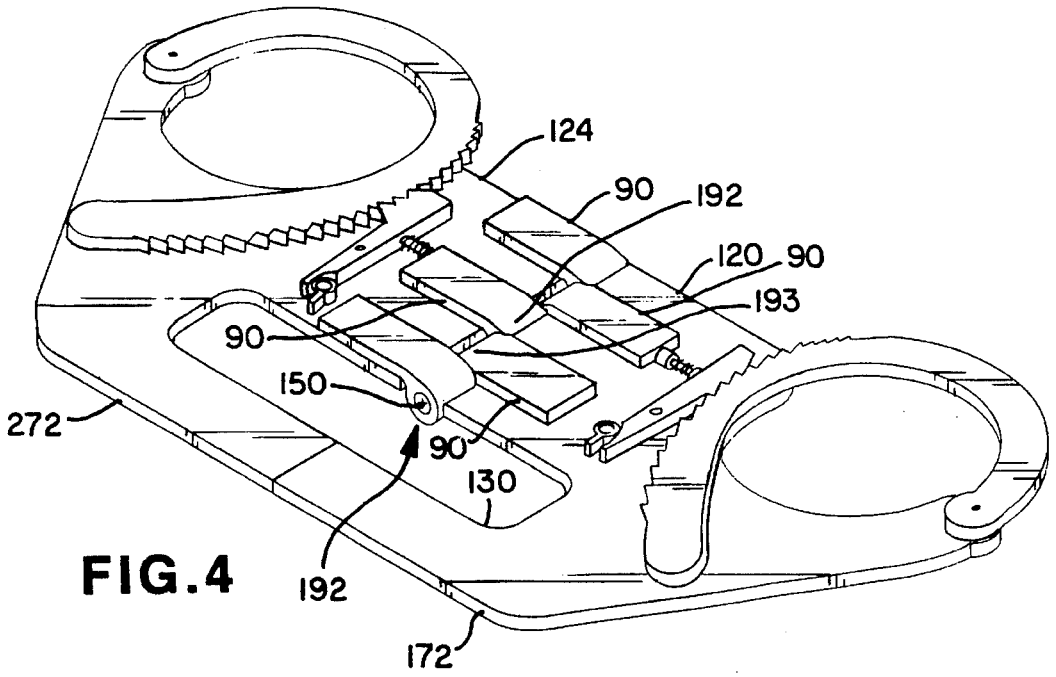
FIG. 4 is a perspective and partially exploded view of the handcuff shown in FIG. 3.

Pin 150 may alternatively be a locking pin. The term locking pin refers to a pin which causes the hinge to lock when it is in an open position. An open position for a hinge for the purposes of this disclosure is as shown in FIGS. 3 and 4. An example of a suitable locking pin is shown in U.S. Pat. No. 2,966,787 which is hereby incorporated by reference.

The spring-loaded pawl of the present invention is shown as an example only. Any means commonly known in the art may be used to lock the handcuffs of the invention, provided, that the locking mechanism only allows one-way rotation of the U-shaped members. Again we refer to U.S. Pat. No. 2,966,787 which fully discloses how the spring-loaded pawl and ratchet operates.

In both of the above-described embodiments the connecting means 18 or 118 contains an opening or aperture 30 or 130 which creates a handle 32 or 132 in the connecting means 18 or 118. The opening 30 or 130 is suitable for an arresting officer to place either a hand or different lever such as a club inside the opening to provide an additional mechanism for the officer to acquire leverage over the detainee. This is particularly important because more and more women are law enforcement officers and the women oftentimes have slighter frames than the suspects they are detaining. An officer may also hold onto the detainee via the aperture 30 or 130 in the handcuff 12 or 112.

Two embodiments of the handcuff of the present invention have been shown. Various modifications may be made without departing from the functional principles of the invention.

We claim:

1. Handcuff assembly for selectively locking a detainee's wrists together, said handcuff assembly comprising:

a first wrist encircling means for selectively encircling one wrist;

a second wrist encircling means for selectively encircling a second wrist;

connecting means for connecting said first wrist encircling means to said second wrist encircling means, said connecting means including a first elongated body having a first end for attaching to said first wrist encircling means and having a second end, said connecting means including a second elongated body means having a first end for attaching to said second wrist encircling means and having a second end, said second ends of said connecting means provided with cooperating hinge rings, a pin disposed between said hinge rings to pivotally couple said second ends of said first and second elongated body means together and to selectively allow pivoting of said elongated body means; and a first handle portion rigidly connected to the first wrist encircling means and a second handle portion rigidly connected to the second wrist encircling means, the first and second handle portions extending to abut each other and thereby defining a handle generally parallel to and spaced apart from the connecting means and defining therebetween an aperture suitable to receive a hand of an officer grasping the handle to allow said handcuff assembly to act as a leverage device to subdue an unruly detainee.

2. The handcuff assembly of claim 1 wherein said pin further comprises a hinge lock assembly for selectively locking said hinge in an open position.

3. A handcuff assembly for selectively locking a detainee's wrists together and subsequently facilitating controlling the detainee, said handcuff comprising:

a first wrist shackle;

a second wrist shackle;

connecting means located directly between the first and second wrist shackles for rigidly connecting said first and second wrist shackles;

a lockable hinge and hinge pin assembly on the connecting means; and a handle rigidly connected the first and second wrist shackleg and situated generally parallel to and spaced apart from the connecting means defining therebetween an opening suitable for receiving a portion of a hand of one grasping the handle to use the handcuff assembly as a leverage device to subdue the detainee.

* * * * *